US008342230B2

(12) United States Patent
Matsuura et al.

(10) Patent No.: US 8,342,230 B2
(45) Date of Patent: Jan. 1, 2013

(54) CASTING METHOD

(75) Inventors: Satoshi Matsuura, Tochigi (JP); Eiji Masuda, Tochigi (JP); Tomohiro Tsuchiya, Tochigi (JP); Akinori Higuchi, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/985,886

(22) Filed: Jan. 6, 2011

(65) Prior Publication Data

US 2011/0174458 A1 Jul. 21, 2011

(30) Foreign Application Priority Data

Jan. 18, 2010 (JP) ..... 2010-007896

(51) Int. Cl.
*B22D 17/22* (2006.01)

(52) U.S. Cl. ..... 164/113; 164/133; 164/312; 164/337

(58) Field of Classification Search ..... 164/113, 164/118, 133, 312, 337, 348
See application file for complete search history.

(56) References Cited

U.S. PATENT DOCUMENTS 5,464,343 A 11/1995 Hepler
5,641,526 A 6/1997 Gellert
5,832,983 A 11/1998 Kuroda et al.
6,308,766 B1 * 10/2001 Thurner ..... 164/61
2011/0011553 A1 * 1/2011 Shibata et al. ..... 164/271

FOREIGN PATENT DOCUMENTS

DE 10 2004 002 883 A1 9/2004
EP 0 778 117 B1 4/2000
EP 1 101 550 B1 1/2005
JP 2002080924 A * 3/2002
JP 2005074445 A * 3/2005
JP 2006-239738 A 9/2006
JP 2010075939 A * 4/2010

OTHER PUBLICATIONS

JPO machine translation of JP 2005074445 A, Mar. 24, 2005.*
JPO machine translation of JP 2006239738 A, Sep. 14, 2006.*

* cited by examiner

*Primary Examiner* — Kevin P Kerns
*Assistant Examiner* — Kevin E Yoon
(74) *Attorney, Agent, or Firm* — Carrier Blackman & Associates, P.C.; William D. Blackman; Joseph P. Carrier

(57) ABSTRACT

A molten metal is fed from a distributor provided in a molten metal introduction portion of a casting die to a cavity of the casting die so as to perform a casting operation. A portion of the distributor to be in contact with the molten metal is made of a copper or a copper alloy. The casting is performed while setting a cavity temperature of the casting die in an initial stage of casting to a predetermined temperature and setting a temperature of the distributor in the initial stage of casting to 65° C. or lower.

8 Claims, 4 Drawing Sheets

CASTING METHOD

BACKGROUND OF THE INVENTION

1. Field of the Invention

The present invention relates to a casting method of a metal material for obtaining a molding product, for example, of an aluminum alloy by a high pressure die casting, and particularly relates to a technique of shortening a cycle time of casting.

2. Related Art

In a die casting such as a high pressure die casting, a member referred to as a distributor is sometimes disposed at a molten metal introduction portion of a casting die for introducing a molten metal to a cavity of the die. In this case, the molten metal injected under pressure from a plunger during casting abuts against the distributor and the molten metal is introduced through a runner formed to the distributor into the cavity of the die. Since the distributor is a member in components of the die which is to be in contact with the molten metal at first, the distributor repetitively receives cooling and heating cycles. In addition, since the distributor is to be in contact with a biscuit portion having a largest thickness in the casting product or a runner, a considerable cooling efficiency is required. Moreover, it is required to smoothly flow the molten metal to the cavity and to solidify the molten metal, a cooling means is provided in the distributor (for example, JP-A-2006-239738).

In the configuration of JP-A-2006-239738, the cooling efficiency of the distributor is improved by a structure of a cooling circuit. By the way, it is also considered to use a metal material having a high thermal conductivity as a material of the distributor, in order to enhance the cooling efficiency. Copper alloys can be considered as the metal material having the high thermal conductivity. However, since the copper alloys are disadvantageous with a view point of wear resistance and strength, alloy tool steels such as SKD (Steel Kogu Die) have been used as the material of the distributor. Further, in a case of using the copper alloys, since copper tends to react with aluminum and suffers from melting loss, it is necessary to form a surface treating film on the surface of the copper by applying a surface treatment (Cr—N system, DLC, Ti—N system, Ti—Al—N system, etc.) by PVD, CVD, PCVD, etc.

However, since the surface treating film has a heat insulating property, the thermal conductivity of the distributor is lowered by the surface treating film. Further, since the surface treating film of the type mentioned above has low oxidation resistance, it also involves a problem of tending to cause cracking or defoliation. When cracking occurs to the surface treating film, since melting loss occurs in the distributor, it is necessary to previously detach the distributor from the die and apply a surface treatment but this makes the process complicate. Further, even in a distributor made of copper alloys, internal cooling water boils when the cycle time is shortened to lower the cooling efficiency and the temperature of the material (molten material) is increased to result in various disadvantages in the operation (remarkable disadvantage in the operation efficiency) such as bursting, scorching, or caulking in a biscuit portion.

SUMMARY OF THE INVENTION

One or more embodiments of the invention provide a casting method capable of suppressing a reaction of a casting material such as aluminum with a distributor made of copper thereby enabling smooth casting and capable of effectively shortening a cycle time by greatly enhancing the cooling efficiency of the distributor.

In accordance with one or more embodiments of the invention, in a casting method in which a molten metal is fed from a distributor disposed to a molten metal introduction portion of a casting die to a cavity of the casting die thereby performing casting, the method is executed by: forming a portion of the distributor in contact with the molten metal of a copper or a copper alloy; and performing the casting while setting a cavity temperature of the casting die in an initial stage of casting to a predetermined temperature and setting a temperature of the distributor in the initial stage of casting to 65° C. or lower.

BRIEF DESCRIPTION OF THE DRAWINGS

FIG. 2(*b*) is a front elevational view of the outer shell.

DETAILED DESCRIPTION OF THE EXEMPLARY EMBODIMENT

An exemplary embodiment of the invention is to be described with reference to the drawings.

<1. Constitution of a Die and a Basic Casting Method>

Figure 1:
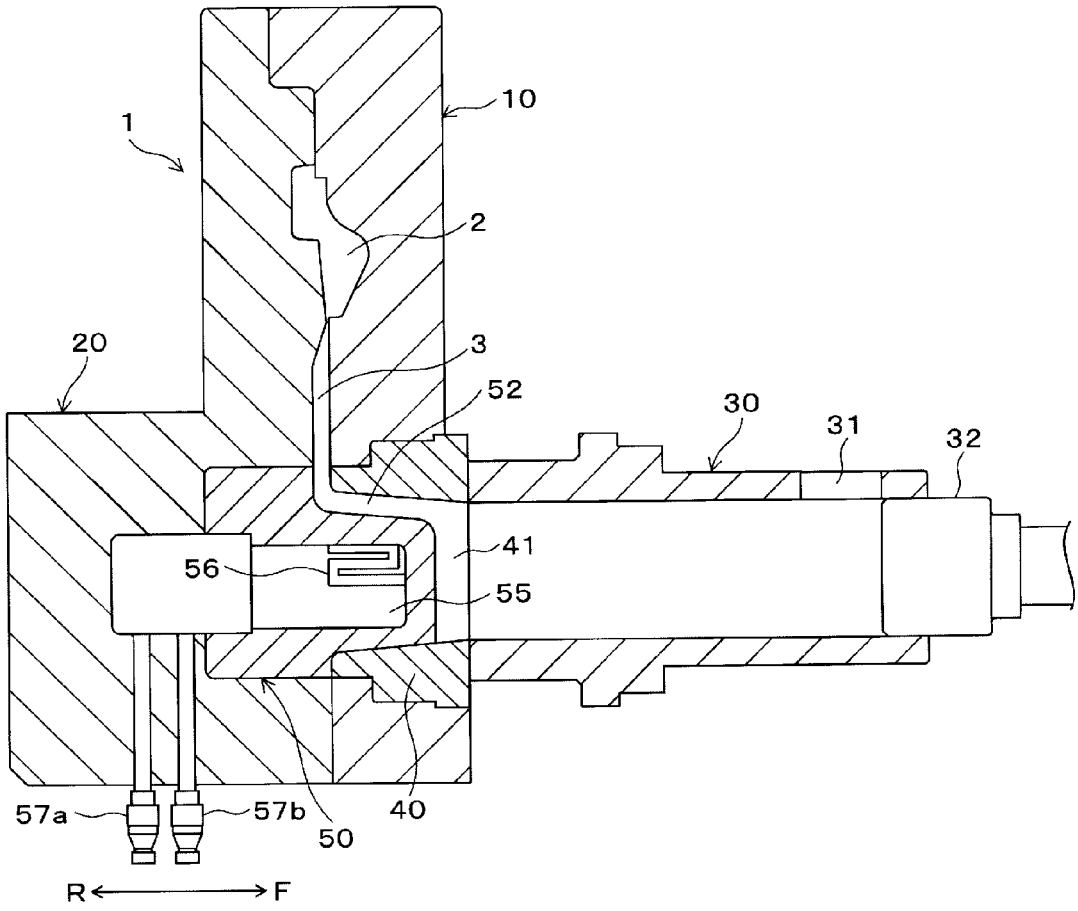
FIG. 1 is a cross sectional view of a die for a casting method according to an exemplary embodiment of the invention.

FIG. 1 shows a casting die 1 for a high pressure die casting applied to a casting method of the exemplary embodiment. The die 1 has a fixed die 10, a movable die 20 disposed so as to be movable relative to the fixed die 10 in the direction of an arrow F-R, and an injection sleeve 30 fixed to the fixed die 10. As shown in FIG. 1, in a clamped state where the movable die 20 advances to the fixed die 10 in the direction F and joined with the mixed die 10, a cavity 2 in which the molten metal is supplied and a casting product is molded, and a runner 3 as a molten metal flow channel at the upstream of the cavity 2 are formed between the fixed die and the movable die.

An annular sprue collar (molten metal introduction port) 40 in which an internal space 41 opens in the moving direction of the moving die 20 is incorporated in the fixed die 10 below the cavity 2. The inner circumferential surface of the sprue collar 40 is formed as a conical shape that is enlarged diametrically toward the movable die 20. A cylindrical injection sleeve 30 is disposed at the back (on the side of right in FIG. 1) of the sprue collar 40.

One end of the injection sleeve 30 is fixed to the fixed die 10, so that an axial direction of the injection sleeve 30 is in parallel with the moving direction of the movable die 20, and the injection sleeve 30 is coaxial with the sprue collar 40. A molten metal injection port 31 is formed on the injection sleeve 30 at an end opposite to the side of the movable die 20 of the injection sleeve 30. A plunger 32 for forcing and supplying the molten metal injected from the molten metal injection port 31 in the direction of the movable die 20 is inserted from the rear end in the injection sleeve 30 so as to be slidable.

Figure 2A:
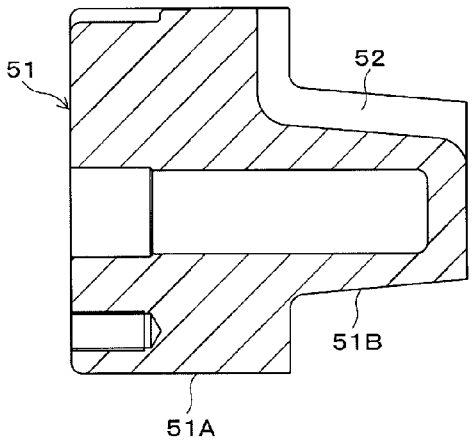
FIG. 2(*a*) is a cross sectional view of an outer shell constituting a distributor mounted to a movable die of a casting die.
Figure 2B:
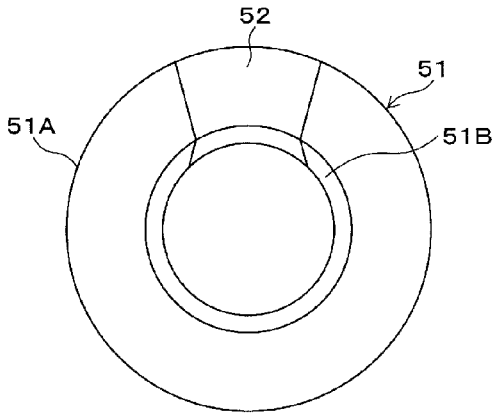

A distributor 50 is detachably mounted in the movable die 20 at a position opposing to the sprue collar 40. The distributor 50 has a cylindrical outer shell 51 and a cooling insert (cooling member) 55 detachably inserted into the outer shell 51. As shown in FIG. 2, in the outer shell 51, a conical portion 51B diametrically reduced toward the end portion is formed integrally at one end of a cylindrical portion 51A having a uniform outer diameter, in which the end on the side of the cylindrical portion 51A is opened and the end on the side of the cylindrical portion 51B is closed. A grooved runner portion 52 is formed from the upper surface of the conical portion 51B to the cylindrical portion 51A in the outer shell 51 for upwardly introducing the molten metal received at the end face of the conical portion 51B.

The distributor 50 is mounted inside the movable die 20 such that its axial direction is in parallel with the advancing and retracting directions of the movable die 20, and the top end of the conical portion 51B of the outer shell 51 extends, into the inner space 41 of the sprue collar 40 with the top end being opposed to the fixed die 10. In the mounted state, a gap of a predetermined thickness is formed between the surface of the distributor 50 on the side of the top end and the sprue collar 40 as an introduction space for the molten metal, and the runner portion 52 is in communication with the runner 3.

Figure 3:
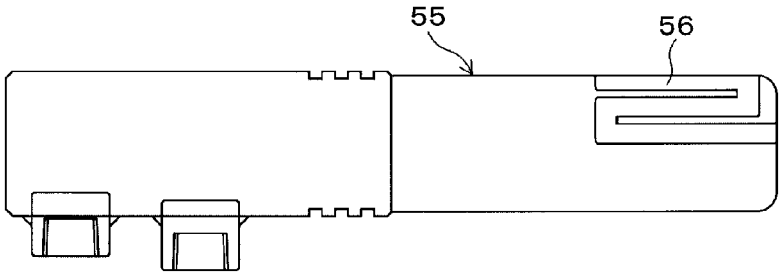
FIG. 3 is a side elevational view of a cooling insert constituting the distributor.
Figure 4:
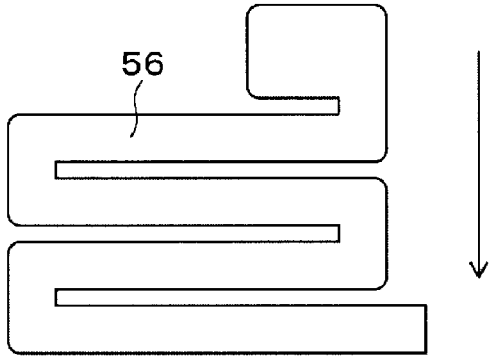
FIG. 4 is a plan view schematically showing a cooling circuit formed in the cooling insert.

As shown in FIG. 3, the cooling insert 55 is entirely formed as a circular cylindrical shape and slidably inserted into the outer shell 51 from the opening on the side of the cylindrical portion 51A. A grooved cooling circuit 56 is formed at the top end of the cooling insert 55 on the side of the insertion end to the outer shell 51 over a region for about one-half of the upper circumferential surface. As shown in FIG. 4, the cooling circuit 56 has such a shape that relatively longer axially extending portions are connected by circumferentially extending (direction of an arrow in FIG. 4) shorter portions in a zigzag manner, and it is formed entirely such that cooling water flows in the circumferential direction. The cooling insert 55 is inserted into the outer shell 51 till the top end surface on the side formed with the cooling circuit 56 abuts against the inner surface at the top end of the conical portion 51B and, in this state, the grooved cooling circuit 56 is covered with the inner surface of the outer shell 51 and formed as a closed water channel.

The cooling insert 55 has such a length that the rear end protrudes from the outer shell 51 in a state inserted in the outer shell 51, and a supply pipe 57*a* and a discharge pipe 57*b* for cooling water are attached to the rear end thereof as shown in FIG. 1. A not illustrated tunnel-like water channel is formed in the cooling insert 55, and the water channel is in communication from one end of the cooling circuit 56 to the supply pipe 57*a* and from the other end of the cooling circuit 56 to the discharge pipe 57*b*.

In the die 1 of the exemplary embodiment described above, a casting product is cast as described below. At first, the movable die 20 is joined with the fixed die 10 into a clamped state to form a cavity 2 and a runner 3 and, at the same time, a plunger 32 is positioned rearward of the molten metal injection port 31 (state shown in FIG. 1). Then, the temperature of the cavity 2 and the runner 3, that is, the temperature of the die is maintained by heating in a range from 100 to 300° C., and cooling water is supplied and caused to flow in the cooling circuit 56 of the distributor 50 to cool the outer shell 51 of the distributor 50. A releasing agent is coated appropriately to a portion in the die where the molten metal is in contact therewith.

The die temperature is maintained in the range from 100 to 300° C. by performing the warming-up operation of only warming the die such as pouring of molten metal and taking out of a molding product for several times (about 5 times) in the warming-up operation. After the warming-up operation, the heating effect due to the heat of the poured molten metal and the cooling effect due to supply of the cooling water and coating of the releasing agent to the die are substantially balanced, so that the die is kept in the range from 100 to 300° C. In a case where the die temperature is lower than 100° C., the coated releasing agent is not evaporated completely to leave a moisture content in the die thereby causing molding defects (casting defects such as shrinkage due to involvement of gas) or causing filling defects due to insufficient filling of the molten metal. On the other hand, in a case where the die temperature exceeds 300° C., seizure or scorching tends to occur to lower the operation efficiency or result in undesired effect on the die. Accordingly, it is necessary to maintain the die temperature in the range from 100 to 300° C.

Then, an appropriate amount of a molten metal (in this case, a molten metal material of aluminum or an aluminum alloy) is injected from the molten metal injection port 31 to the injection sleeve 30, then the plunger 32 is advanced in the direction of the movable die 20 to force the molten metal from the injection sleeve 30 to the inside of the die 1 at a predetermined pressure. Thus, the molten metal at first abuts against the top end of the outer shell 51 of the distributor 50, passes through the runner portion 52, ascends in the runner 3 and is then filled from the runner 3 to the inside of the cavity 2. After the lapse of a cure time for solidification in which the molten metal is solidified in a state where the plunger 32 is forced to advance as it is, the movable die 20 is moved in the direction R in FIG. 1 and retracted from the fixed die 10 thereby completing the casting. The foregoing processes form one casting cycle.

<2. Distributor>

Then, description is to be made to the material of the distributor 50 according to the exemplary embodiment and the cooling condition of the distributor 50, etc. in the casting method described above.

<2-1. Material of Distributor>

The outer shell 51 of the distributor 50 is made of copper or a copper alloy and, specifically, a copper alloy referred to as Corson copper (Cu-1.5 to 3.0 wt % Ni, 0.3 to 1.0 wt % Si), etc. are used suitably. That is, the surface of the outer shell 51 to be in contact with the molten metal is made of copper or a copper alloy. The surface of the outer shell 51 undergoes no surface treatment and a surface coating film, etc. are not formed thereon at all. Further, the cooling insert 55 of the distributor 50 is formed of a material identical with that of the fixed die 10 or the movable die 20 (for example, steel such as SKD and SS (Steel Structure (e.g. SS400))).

<2-2. Temperature of Distributor at Initial Casting Stage>

At an initial casting stage, that is, when the plunger 32 is plunged and the molten metal is abutted against the distributor 50 and sent to the cavity 2, the temperature of the outer shell 51 of the distributor 50 (internal temperature near the surface in contact with the molten metal, for example, a temperature in a region from the surface to a depth of about 5 mm) is set to 65° C. or lower. The temperature of the outer shell 51 can be controlled to 65° C. or lower by controlling the temperature and the flow rate of the cooling water flowing in the cooling circuit 56.

When aluminum or an aluminum alloy is cast under the conditions of the distributor 50 as described above, since the temperature of the outer shell 51 is kept at a low temperature of 65° C. or lower when the molten metal flows to the runner 3 while being in contact with the outer shell 51 of the distributor 50, the molten metal is cooled by the outer shell 51 and solidified rapidly. The temperature of the outer shell 51 is kept to 65° C. or lower clearly because the outer shell 51 is formed of copper or a copper alloy and has a high thermal conductivity and high cooling efficiency.

Figure 5:
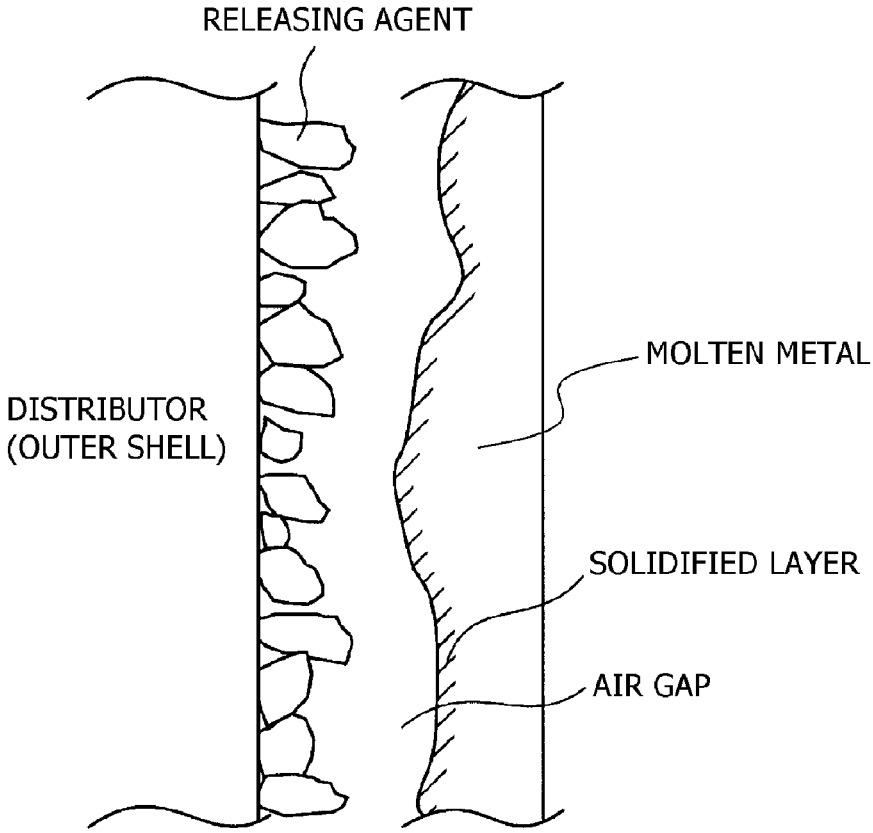
FIG. 5 is a view schematically showing a state where a molten metal in contact with the distributor is solidified to form an air gap between them.

When the molten metal in contact with the outer shell 51 is solidified, solidification shrinkage occurs and since the extent of the solidification shrinkage is large due to rapid cooling, the solidified layer of the molten metal defoliates from the outer shell 51. As shown in FIG. 5, since the solidified layer of the molten metal defoliates from the outer shell 51, an air gap is formed between both of them. The air gap is larger compared with a case where the distributor 50 comprises SKD or the like having lower cooling efficiency compared with copper or a copper alloy. Accordingly, an area of contact between the molten metal that forms the solidified layer on the side of the distributor 50 and the outer shell 51 is decreased and the surface roughness is increased.

Increase of the air gap as described above provides a function and an effect that the reaction is suppressed even when the molten metal is aluminum or an aluminum alloy that tends to react with the outer shell 51 comprising copper or copper alloy and the molten loss is not generated to the outer shell 51 of the distributor 50. Further, once after such a large air gap is formed (time to form the air gap is, for example, about 1 to 2 sec and the filling of the molten metal into the cavity 2 is completed within the time to form the air gap), the air gap is shrank by the pressure undergoing from the plunger 32 and a biscuit portion that is solidified in the sprue collar 40 can be solidified rapidly. As the result, even when the distributor 50 comprises copper or a copper alloy, smooth casting is performed, and the quality can be maintained while the casting product is solidified rapidly. Further, the cycle time can be shortened thereby enabling to increase the yield and decrease the cost.

Further, since no coating film is applied by the surface treatment at the surface of the outer shell 51 in contact with the molten metal, high thermal conductivity of copper is not deteriorated and high cooling efficiency can be provided as described above. Then, since the surface treating coating film is not present, this provides an advantage not requiring complicate maintenance in a case of cracking or defoliation generated on the surface treating coating film. Further, since the cooling insert 55 formed of steel such as SKD and SS is inserted inside the outer shell 51 which has disadvantage in view of the strength and the outer shell is in a state supported from the inside by the cooling insert 55 so as to be less deformed, this structure can suppress the deformation of the outer shell 51.

EXAMPLE AND COMPARATIVE EXAMPLE

Example

A distributor of a constitution identical with that in the exemplary embodiment described above and having an outer shell comprising Corson copper and a cooling insert comprising SS is mounted to a movable die, and aluminum was cast by high pressure die casting. The temperature of the distributor in the initial casting stage was set to 65° C. and 45° C., and a plurality of samples were cast respectively.

Comparative Example

Casting was conducted in the same manner as the example except for mounting a distributor comprising SKD to a die and setting the initial temperature of the distributor to 150° C. and 120° C.

[Measurement for Surface Roughness]

Figure 6:
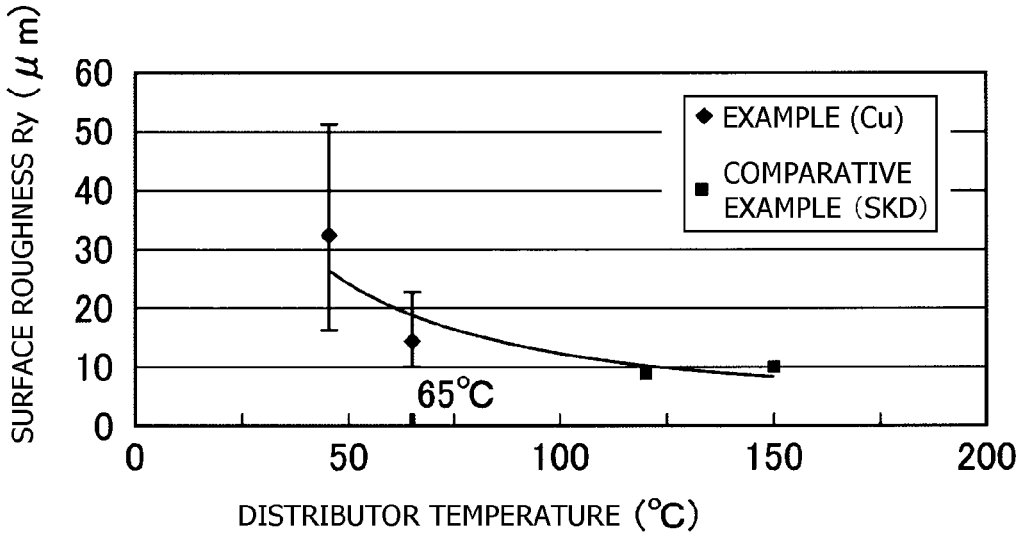
FIG. 6 is a graph showing a result of measurement for surface roughness in a biscuit portion of a casting product in an example.

For the casting products of the example and the comparative example, the surface roughness (Ry) at the contact surface of the biscuit portion to the distributor was measured. The result is shown in FIG. 6. According to FIG. 6, it is estimated that the contact surface of the biscuit portion to the distributor is coarser and the air gap is larger in the case of the example than in the case of the comparative example. Accordingly, it has been found that when the initial casting temperature of the distributor made of the copper alloy is 65° C. or lower, the area of contact of the molten metal to the distributor is decreased thereby causing no melting loss and casting is performed appropriately while rapidly cooling the molten metal more effectively by the distributor than in the case of the distributor made of SKD.

In accordance with the exemplary embodiment of the invention, in a casting method in which a molten metal is fed from a distributor disposed to a molten metal introduction portion of a casting die to a cavity of the casting die thereby performing casting, the method is executed by: forming a portion of the distributor in contact with the molten metal of a copper or a copper alloy; and performing the casting while setting a cavity temperature of the casting die in an initial stage of casting to a predetermined temperature and setting a temperature of the distributor in the initial stage of casting to 65° C. or lower.

According to the above method, since the temperature of the distributor comprising copper or a copper alloy is set to 65° C. or lower in the initial stage of casting, when the casting material such as aluminum is in contact with the distributor, formation of a solidified layer of the casting material and defoliation of the solidified layer from the distributor due to solidification shrinkage tend to occur in a stage before the reaction between both of them. Accordingly, reaction of the casting material with the distributor is suppressed to enable smooth casting. Further, the biscuit portion can be solidified rapidly and, as a result, the cycle time can be shortened.

In the method of the exemplary embodiment, the distributor may have a cooling member made of steel, and a cooling circuit for cooling the distributor may be formed in the cooling member.

Further, in accordance with the exemplary embodiment, a casting die may be provided with: a fixed die 10; a movable die 20 which is movable relative to the fixed die 10; a sprue collar 40 provided on the fixed die 10 and including an internal space 41 which opens in a moving direction of the moving die 20; and a distributor 50 mounted on the movable die 20 and opposing to the sprue collar 40. The distributor 50 may include an outer shell 51 and a cooling member 55. The outer shell 51 may include an end having an outer shape of capable of intruding into the inner space 41 of the sprue collar 40. A surface of the outer shell 51, arranged to be in contact with a molten metal, may be formed of a copper or a copper alloy. Any surface coating films are not formed on said surface of the outer shell 51 to be in contact with the molten metal. The cooling member 55 may include a cooling circuit 56 in which a cooling agent for cooling the distributor flows.

According to the embodiment, it becomes possible to suppress a reaction of a casting material such as aluminum with a distributor made of copper to enable smooth casting, and to effectively shorten a cycle time by remarkably enhancing the cooling efficiency of the distributor.

[Description of Reference Numerals and Signs]

1 Die
2 Cavity
3 Runner
10 Fixed die

20 Movable die
30 Injection sleeve
32 Plunger
40 Sprue collar (molten metal introduction port)
50 Distributor
51 Outer shell
55 Cooling insert (cooling member)
56 Grooved cooling circuit

What is claimed is:

1. A casting method in which a molten metal is fed from a distributor, disposed at a molten metal introduction portion of a casting die, to a cavity of the casting die thereby performing casting, the method comprising:

preheating the casting die to a predetermined temperature between 100 and 300 degrees Centigrade;

setting a temperature of the distributor in an initial stage of casting in a range of 65° C. or lower:

advancing a plunger;

contacting a runner portion of the distributor with the molten metal, where said runner portion comprises copper or copper alloy with no surface treatment;

performing the casting by feeding the molten metal past the distributor to the cavity of the casting die;

keeping the temperature of the distributor in the range of 65° C. or lower until an air gap is formed by causing a portion of the molten metal proximate the runner portion of the distributor to partially solidify and move away from the distributor: and shrinking the air gap by a pressure of the plunger.

2. The casting method according to claim 1, wherein the distributor comprises a cooling member made of steel, and wherein a cooling circuit for cooling the distributor is formed in the cooling member.

3. The casting method of claim 1, wherein said molten metal comprises aluminum.

4. The casting method of claim 1, wherein said runner portion comprises a copper alloy comprising nickel in a range of 1.5 to 3.0 percent by weight of the alloy, and silicon in a range of 0.3 to 1.0 percent by weight of the alloy.

5. The casting method of claim 1, wherein the runner portion of the distributor is free of surface hardening treatments.

6. A casting method in which a molten metal is fed from a distributor, disposed at a molten metal introduction portion of a casting die, to a cavity of the casting die thereby performing casting, the method comprising:

preheating the casting die to a predetermined temperature in a range between 100 and 300 degrees centigrade;

setting a temperature of the distributor in an initial stage of casting to 65 degrees centigrade or lower;

advancing a plunger;

contacting a runner portion of the distributor with the molten metal comprising aluminum, where said runner portion comprises copper or a copper alloy;

performing the casting by feeding the molten metal past the distributor to the cavity of the casting die;

keeping the temperature of the distributor in the range of 65 degrees centigrade or lower until an air gap is formed by causing a portion of the molten metal proximate the runner portion of the distributor to partially solidify and move away from the distributor;

and shrinking the air gap by a pressure of the plunger;

wherein the distributor comprises a cooling member made of steel, and wherein a cooling circuit for cooling the distributor is formed in the cooling member.

7. The casting method of claim 6, wherein said runner portion comprises a copper alloy comprising nickel in a range of 1.5 to 3.0 percent by weight of the alloy, and silicon in a range of 0.3 to 1.0 percent by weight of the alloy.

8. The casting method of claim 6, wherein the runner portion of the distributor is free of surface hardening treatments.

* * * * *